US009931726B2

(12) United States Patent
Chang et al.

(10) Patent No.: US 9,931,726 B2
(45) Date of Patent: Apr. 3, 2018

(54) WAFER EDGE TRIMMING TOOL USING ABRASIVE TAPE

(71) Applicant: Taiwan Semiconductor Manufacturing Company, Ltd., Hsin-Chu (TW)

(72) Inventors: Tang-Kuei Chang, Tainan (TW); Kuo-Hsiu Wei, Tainan (TW); Kei-Wei Chen, Tainan (TW); Huai-Tei Yang, Hsin-Chu (TW); Ying-Lang Wang, Tien-Chung Village (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 165 days.

(21) Appl. No.: 13/836,439

(22) Filed: Mar. 15, 2013

(65) Prior Publication Data

US 2014/0213152 A1 Jul. 31, 2014

Related U.S. Application Data

(60) Provisional application No. 61/759,098, filed on Jan. 31, 2013, provisional application No. 61/759,076, filed on Jan. 31, 2013.

(51) Int. Cl.

| | |
|---|---|
| ***B24B 9/06*** | (2006.01) |
| ***B24B 21/00*** | (2006.01) |
| ***B24B 21/04*** | (2006.01) |

(52) U.S. Cl.

CPC ..... *B24B 9/065* (2013.01); *B24B 21/004* (2013.01); *B24B 21/04* (2013.01)

(58) Field of Classification Search

CPC ..... B24B 9/065; B24B 1/00; B24B 21/02; B24B 21/004; H01L 21/02021

USPC ..... 451/44, 168, 173, 533, 539

See application file for complete search history.

(56) References Cited

U.S. PATENT DOCUMENTS

| | | | | |
|---|---|---|---|---|
| 5,209,027 | A | 5/1993 | Ishida et al. | |
| 5,643,044 | A | 7/1997 | Lund | |
| 5,938,504 | A | 8/1999 | Talieh | |
| 6,193,590 | B1 * | 2/2001 | Weiss | B24B 21/06 451/163 |
| 6,413,873 | B1 | 7/2002 | Li et al. | |
| 6,439,978 | B1 | 8/2002 | Jones et al. | |
| 7,367,873 | B2 * | 5/2008 | Ishii et al. | 451/168 |
| 7,621,799 | B2 * | 11/2009 | Sakairi | 451/36 |
| 7,976,361 | B2 * | 7/2011 | Takahashi et al. | 451/44 |
| 8,641,480 | B2 * | 2/2014 | Nakanishi et al. | 451/56 |
| 2001/0011002 | A1 * | 8/2001 | Steere, III | 451/168 |
| 2002/0016136 | A1 | 2/2002 | Birang et al. | |
| 2002/0098787 | A1 * | 7/2002 | Kunisawa et al. | 451/307 |
| 2002/0142707 | A1 * | 10/2002 | Shimada et al. | 451/44 |
| 2004/0072504 | A1 * | 4/2004 | Tada | 451/41 |
| 2006/0252355 | A1 * | 11/2006 | Kumasaka | 451/44 |
| 2007/0044386 | A1 * | 3/2007 | Yamaguchi | C09G 1/02 51/308 |
| 2007/0131654 | A1 * | 6/2007 | Wasinger et al. | 216/88 |
| 2008/0293331 | A1 * | 11/2008 | Chen | B24B 9/065 451/37 |

(Continued)

*Primary Examiner* — Monica Carter
*Assistant Examiner* — Lauren Beronja
(74) *Attorney, Agent, or Firm* — Slater Matsil, LLP

(57) ABSTRACT

A wafer edge trimming tool includes an abrasive tape and a holding module configured to hold the abrasive tape against portions of an edge of a rotating wafer during a wafer edge trimming process.

20 Claims, 1 Drawing Sheet

(56) References Cited

U.S. PATENT DOCUMENTS

| | | | | |
|---|---|---|---|---|
| 2008/0293335 | A1* | 11/2008 | Ettinger et al. | 451/41 |
| 2009/0004952 | A1* | 1/2009 | Takahashi et al. | 451/44 |
| 2009/0117828 | A1* | 5/2009 | Hongo et al. | 451/6 |
| 2010/0112909 | A1* | 5/2010 | Yamaguchi et al. | 451/44 |

* cited by examiner

WAFER EDGE TRIMMING TOOL USING ABRASIVE TAPE

This application claims the benefit of U.S. Provisional Application No. 61/759,098, filed on Jan. 31, 2013, entitled "Wafer Edge Trimming Tool Using Abrasive Tape," and U.S. Provisional Application No. 61/759,076, filed on Jan. 31, 2013, entitled "Wafer Polishing Tool Using Abrasive Tape," which applications are hereby incorporated herein by reference.

This application relates to the following commonly assigned patent application filed on the same date as this application and entitled "Wafer Polishing Tool Using Abrasive Tape," which application is included herein by reference.

TECHNICAL FIELD

The present disclosure relates generally to an integrated circuit and more particularly to a wafer edge trimming tool.

BACKGROUND

During some integrated circuit (IC) manufacturing processes, a wafer edge may be trimmed to reduce the likelihood of damage to the wafer during subsequent process steps (e.g., thinning). Typically, wafer edge trimming involves applying downward force to a wafer edge using a blade. However, the use of a blade during wafer edge trimming may introduce a high degree of stress to the wafer, which may cause damage such as wafer peeling, chipping, cracking, and the like.

BRIEF DESCRIPTION OF THE DRAWINGS

For a more complete understanding of the present embodiments, and the advantages thereof, reference is now made to the following descriptions taken in conjunction with the accompanying drawings, in which.

DETAILED DESCRIPTION OF ILLUSTRATIVE EMBODIMENTS

Figure 1:
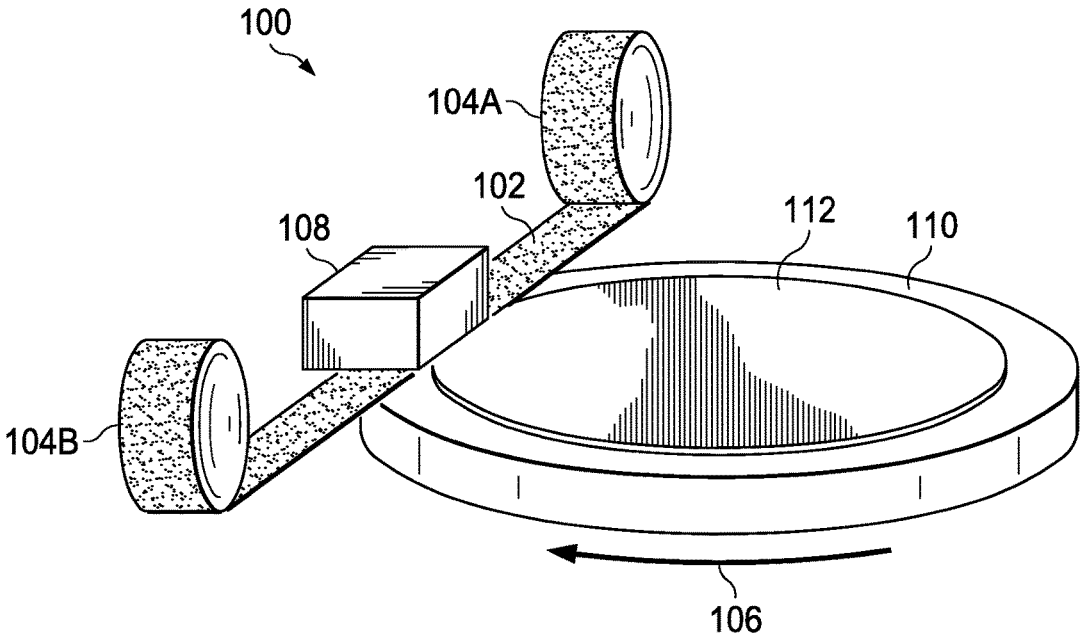
FIG. 1 is a schematic diagram of an exemplary wafer edge trimming tool according to various embodiments.

The making and using of the present embodiments are discussed in detail below. It should be appreciated, however, that the present disclosure provides many applicable inventive concepts that can be embodied in a wide variety of specific contexts. The specific embodiments discussed are merely illustrative of specific ways to make and use the disclosed subject matter, and do not limit the scope of the different embodiments.

In addition, the present disclosure may repeat reference numerals and/or letters in the various examples. This repetition is for the purpose of simplicity and clarity and does not in itself dictate a relationship between the various embodiments and/or configurations discussed. Moreover, the formation of a feature on, connected to, and/or coupled to another feature in the present disclosure that follows may include embodiments in which the features are formed in direct contact, and may also include embodiments in which additional features may be formed interposing the features, such that the features may not be in direct contact. In addition, spatially relative terms, for example, "lower," "upper," "horizontal," "vertical," "above," "over," "below," "beneath," "up," "down," "top," "bottom," etc. as well as derivatives thereof (e.g., "horizontally," "downwardly," "upwardly," etc.) are used for ease of the present disclosure of one features relationship to another feature. The spatially relative terms are intended to cover different orientations of the device including the features.

Various embodiments include using an abrasive tape in lieu of a blade to perform edge trimming on various wafers. Edges of a semiconductor wafer may be rotated against the abrasive tape as downward pressure is applied to the abrasive tape, holding a portion of the abrasive tape in position. The rotation of the semiconductor wafer against the rough surface of the abrasive tape has the same effect as a blade in conventional wafer edge trimming techniques without applying high-stress to the wafer.

FIG. 1 is a schematic diagram of an exemplary wafer edge trimming tool 100 according to various embodiments. Wafer edge trimming tool 100 includes an abrasive tape 102, a holding module 104 (having first and a second holding parts 104A and 104B respectively), a polishing head 108, and a rotation module 110. A wafer 112 is placed on rotation module 110. Wafer 112 may be a semiconductor wafer comprising silicon, silicon dioxide, aluminum oxide, sapphire, germanium, gallium arsenide (GaAs), an alloy of silicon and germanium, indium phosphide (InP), and/or any other suitable material.

Holding module 104 holds and dispenses abrasive tape 102 under a polishing head 108. As illustrated, in FIG. 1, holding module 104 (holding abrasive tape 102) and polishing head 108 are disposed on an edge region of wafer 112. Rotation module 110 rotates and feeds portions of edges of wafer 112 under polishing head 108 and abrasive tape 102 during the wafer trimming process as indicated by arrow 106. For example, rotation module 110 may rotate wafer 112 at about 700 rpm. Although FIG. 1 illustrates rotation module 110 rotating wafer 112 in the clockwise direction indicated by arrow 106, rotation module 110 may also rotate wafer 112 in the opposite, e.g., counter-clockwise, direction as well.

As wafer 112 is rotated by the rotation module 110 against abrasive tape 102, polishing head 108 applies downward force to abrasive tape 102. The downward force positions abrasive tape 102 against edge portions of the wafer 112 for edge trimming. For example, polishing head 108 may apply a downward force between about 7N to about 9N so that abrasive tape 102 may be held in place against rotating wafer 112. Edges of wafer 112 are trimmed as portions come in contact with and are polished by abrasive tape 102. Thus, edges of wafer 112 may be trimmed without the use of a high-stress inducing blade.

In various embodiments, abrasive tape 102 may be an abrasive material bonded to a base film (sometimes referred to as a base tape). The abrasive material is oriented facing towards the wafer during wafer edge trimming. For example, in FIG. 1, the abrasive material of abrasive tape 102 would be oriented facing downward (contacting wafer 112) while the base film of abrasive tape 102 would be oriented facing upward (contacting polishing head 108). The abrasive material may be diamond, diamond powder, silica dioxide, cerium oxide, silicon carbide, aluminum oxide, combinations thereof, and the like. The base film may be formed of polyethylene terephthalate (PET), polyester, or the like. Furthermore, abrasive tape 102 may have a width between 2 mm to 20 mm and a length of 50 m or more.

For example, abrasive tape 102 may include diamond powder having a grain size between 0.5 μm to 30 μm that is bonded to a polyester base film with a thickness between 20 μm to 150 μm. In another example, abrasive tape 102 may include a 12 μm thick layer of diamond powder having a 9 μm grain size bonded to a PET base film having a width of 4 mm, a thickness of 125 μm, and a length of 50 m. Because of the abrasive tape 102 may include diamonds or diamond powder, abrasive tape 102 may alternatively be referred to as diamond tape 102.

Holding parts 104A and 104B may be formed of stainless steel, aluminum, or any other suitable material. Polishing head 108 may be formed of silicon carbide (SiC), or any other suitable material and may have dimensions of, for example, about 30 mm in length and 15 mm in width.

In various embodiments, abrasive tape 102 may be stored in a roll and dispensed from disks (e.g., holding parts 104A and 104B) holding the roll. As portions of abrasive tape 102 come in contact with wafer 112, these portions may become worn and require periodic replacement. By storing abrasive tape 102 in a roll on a disk, fresh (i.e., unworn) portions of abrasive tape 102 may be dispensed (i.e., rolled out) automatically as used portions of abrasive tape 102 become worn. The wafer edge trimming process may proceed with minimum interruptions using a fresh portion of abrasive tape 102. That is, the wafer edge trimming process need not be interrupted frequently to replace worn portions of abrasive tape because fresh portions are rolled out automatically.

For example, in various embodiments, holding parts 104A and 104B are rollers holding abrasive tape 102 in position during the wafer edge trimming process. In one example, holding parts 104A may store fresh abrasive tape and holding part 104B roll may store used portions as they become worn. Alternatively, holding parts 104A and 104B are configured in a different shape that hold abrasive tape 102 in position during the wafer trimming process, and worn portions of abrasive tape 102 may be replaced manually as needed.

Figure 2:
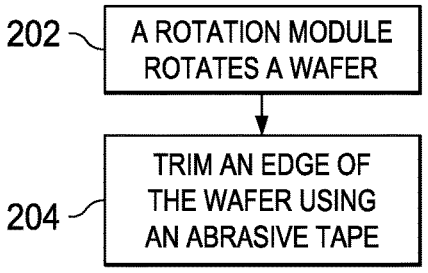
FIG. 2 is a flowchart of an exemplary method using the wafer edge trimming tool in FIG. 1 according to various embodiments.

FIG. 2 is a flowchart of an exemplary method using the wafer edge trimming tool illustrated in FIG. 1 according to various embodiments. At step 202, a rotation module (e.g., rotation module 110) rotates a wafer (e.g., wafer 112). The wafer is placed on the rotation module and a holding module (e.g., holding module 104), holding an abrasive tape (e.g., abrasive tape 102), is disposed over an edge of the wafer. The holding module may include a first part and a second part (e.g., holding parts 104A and 104B) that hold a portion of the abrasive tape in position between the first and the second part of the holding module during the wafer edge trimming process. Furthermore, the first and the second part of the holding module may be rollers that periodically dispense (i.e., roll out) fresh portions of the abrasive tape in position during the wafer edge trimming process. Dispensing fresh portions of the abrasive tape may be necessary as used portions become worn out.

In step 204, the edge of the wafer is trimmed using the abrasive tape. A polishing head (e.g., polishing head 108) may apply downward force to a portion of the abrasive tape so that it comes in contact against an edge of the wafer. As the rotating module rotates the edge of the wafer against the abrasive tape, the edges are trimmed. In various embodiments, the use of an abrasive tape in lieu of a traditional edge trimming blade subjects the wafer to less stress during the wafer edge trimming process and decreases the likelihood of damage to the wafer.

In various embodiments, the abrasive tape comprises an abrasive material layer bonded to a base film. The abrasive material layer comprises diamond, diamond powder, silica dioxide, cerium oxide, silicon carbide, aluminum oxide, any combination thereof, or any other suitable material. For example, the abrasive material may include a diamond powder having a grain size ranging from about 0.5 μm to 30 μm bonded to a polyethylene terephthalate (PET) or polyester base film.

In accordance with an embodiment, a wafer edge trimming tool includes an abrasive tape and a holding module configured to hold the abrasive tape against portions of an edge of a rotating wafer during a wafer edge trimming process.

In accordance with another embodiment, a method of wafer edge trimming includes rotating a wafer and trimming an edge of the wafer by rotating the edge of the wafer against an abrasive tape.

In accordance with yet another embodiment, a wafer edge trimming tool includes a diamond tape including diamond powder, a holding module, a polishing head configured to hold the diamond tape against an edge of a wafer during a wafer edge trimming process, and a rotation module configured to rotate the wafer, wherein the diamond tape is held over the edge of the wafer by the holding module.

Various embodiments perform the wafer edge trimming process with less stress compared with conventional methods. It has been observed that wafers processed with wafer edge trimming tool 100 showed reduced damage (e.g., edge peeling or cracking) compared to wafers processed with conventional methods. In an example, peak shift data measurements showed wafer edge trimming tool 100 only causing $1/6^{th}$ the amount of stress to a wafer compared to the stress caused by conventional edge trimming tools using a blade. In another example, crystalline data measurements showed wafer edge trimming tool 100 only causing $1/10^{th}$ the amount of stress to a wafer compared to the stress caused by conventional edge trimming tools using a blade.

A skilled person in the art will appreciate that there can be many embodiment variations of this disclosure. Although the embodiments and their features have been described in detail, it should be understood that various changes, substitutions and alterations can be made herein without departing from the spirit and scope of the embodiments. Moreover, the scope of the present application is not intended to be limited to the particular embodiments of the process, machine, manufacture, and composition of matter, means, methods and steps described in the specification. As one of ordinary skill in the art will readily appreciate from the disclosed embodiments, processes, machines, manufacture, compositions of matter, means, methods, or steps, presently existing or later to be developed, that perform substantially the same function or achieve substantially the same result as the corresponding embodiments described herein may be utilized according to the present disclosure.

The above method embodiment shows exemplary steps, but they are not necessarily required to be performed in the order shown. Steps may be added, replaced, changed order, and/or eliminated as appropriate, in accordance with the spirit and scope of embodiment of the disclosure. Embodiments that combine different claims and/or different embodiments are within the scope of the disclosure and will be apparent to those skilled in the art after reviewing this disclosure.

What is claimed is:

1. A wafer edge trimming tool, comprising:

an abrasive tape;

a holding module configured to hold the abrasive tape against portions of an edge of a rotating semiconductor wafer during a wafer edge trimming process, the holding module comprising a first holding part and a second holding part, wherein:

the first holding part holds a first portion of the abrasive tape;

the second holding part holds a second portion of the abrasive tape; and a third portion of the abrasive tape extends between the first holding part and the second holding part; and a polishing head positioned vertically over the abrasive tape and the edge of the rotating semiconductor wafer, wherein:

a width of the polishing head is larger than a width of the abrasive tape;

the polishing head is configured to apply downward force to the third portion of the abrasive tape so that the third portion of the abrasive tape is in contact with the rotating semiconductor wafer during the wafer edge trimming process, where application of downward force is in a direction substantially parallel to an axis of rotation of the rotating semiconductor wafer;

a position of the polishing head is constant during the wafer edge trimming process; and the polishing head is different than and interposed between the first holding part and the second holding part.

2. The wafer edge trimming tool of claim 1, wherein the polishing head comprises silicon carbide (SiC).

3. The wafer edge trimming tool of claim 1, further comprising a rotation module configured to rotate the rotating semiconductor wafer during the wafer edge trimming process.

4. The wafer edge trimming tool of claim 1, wherein the abrasive tape comprises an abrasive material bonded to a base film.

5. The wafer edge trimming tool of claim 4, wherein the abrasive material comprises diamond, silica dioxide, cerium oxide, silicon carbide, aluminum oxide, or any combination thereof.

6. The wafer edge trimming tool of claim 4, wherein the abrasive material comprises diamond powder with a grain size ranging from about 0.5 μm to about 30 μm.

7. The wafer edge trimming tool of claim 4, wherein the base film comprises polyethylene terephthalate (PET) or polyester.

8. The wafer edge trimming tool of claim 1, wherein the holding module is configured to position a portion of the abrasive tape between the first holding part and the second holding part during the wafer edge trimming process.

9. The wafer edge trimming tool of claim 8, wherein the first holding part and the second holding part are rollers.

10. The wafer edge trimming tool of claim 1, wherein the polishing head is disposed over the rotating semiconductor wafer during the wafer edge trimming process.

11. A method of wafer edge trimming, comprising:

rotating a wafer, the wafer having a major surface, the major surface comprising an inner region and an outer periphery region;

positioning a portion of an abrasive tape over the outer periphery region of the wafer with a holding module, wherein:

the holding module has a first holding part and a second holding part;

a first portion of the abrasive tape is held by the first holding part;

a second portion of the abrasive tape is held by the second holding part; and a third portion of the abrasive tape extends between the first holding part and the second holding part;

trimming the outer periphery region of the wafer by rotating the wafer against the abrasive tape, wherein trimming the outer periphery region of the wafer comprises positioning a polishing head vertically over the third portion of the abrasive tape and the outer periphery region of the wafer and applying, by the polishing head, downward force to the third portion of the abrasive tape against the outer periphery region of the wafer, wherein:

a position of the polishing head is constant while trimming the outer periphery region of the wafer;

the polishing head is interposed between the first holding part and the second holding part at a same level and in a direction substantially parallel to the major surface of the wafer; and a width of the polishing head is larger than a width of the abrasive tape.

12. The method of claim 11, wherein rotating the wafer comprises placing the wafer on a rotation module.

13. The method of claim 11, wherein the portion of the abrasive tape is disposed between the first holding part and the second holding part.

14. The method of claim 11, further comprising rolling out a fresh portion of the abrasive tape, wherein the fresh portion is positioned against the outer periphery region of the wafer.

15. The method of claim 11, wherein the abrasive tape comprises an abrasive material bonded to a base tape.

16. The method of claim 15, wherein the abrasive material comprises diamond, silica dioxide, cerium oxide, silicon carbide, aluminum oxide, or any combination thereof.

17. The method of claim 15, wherein the abrasive material comprises diamond powder with a grain size ranging from about 0.5 μm to about 30 μm.

18. The method of claim 15, wherein the base tape comprises polyethylene terephthalate (PET) or polyester.

19. A wafer edge trimming tool, comprising:

a diamond tape including diamond powder bonded to a base film;

a holding module comprising a first holding part and a second holding part laterally separated from the first holding part, wherein a first portion of the diamond tape is held by the first holding part, wherein a second portion of the diamond tape is held by the second holding part, and wherein a third portion of the diamond tape extends between the first holding part and the second holding part;

a polishing head between and laterally separated from the first holding part and the second holding part, the polishing head configured to physically contact the base film of the third portion of the diamond tape and press the diamond powder of the third portion of the diamond tape against an edge of a wafer during a wafer edge trimming process, the polishing head further positioned vertically over the third portion of the diamond tape and the edge of the wafer, wherein a width of the polishing head is larger than a width of the diamond tape, wherein a lateral position of the polishing head is constant during the wafer edge trimming process, and wherein the polishing head is configured to exert a downward force on the third portion of the diamond tape, the downward force having a magnitude in a range from about 7 Newtons to about 9 Newtons; and a rotation module configured to rotate the wafer.

20. A method of wafer edge trimming, comprising:

placing a wafer on a rotation module;

positioning a polishing head vertically over an edge portion of the wafer;

placing an abrasive tape in a holding module, the holding module having a first holding part and a second holding part laterally separated from the first holding part, wherein a first portion of the abrasive tape is held by the first holding part, wherein a second portion of the abrasive tape is held by the second holding part, wherein a third portion of the abrasive tape extends between the first holding part and the second holding part, and wherein the polishing head is laterally between the first holding part and the second holding part;

positioning the polishing head vertically over the third portion of the abrasive tape and the edge portion of the wafer;

applying a downward force in a range from about 7 Newtons to about 9 Newtons to the third portion of the abrasive tape using the polishing head, the downward force bringing the third portion of the abrasive tape in physical contact with the edge portion of the wafer, the downward force also bringing the polishing head in physical contact with the third portion of the abrasive tape; and rotating the wafer using the rotation module, wherein a lateral position of the polishing head is constant during the rotation of the wafer, wherein a width of the polishing head is larger than a width of the abrasive tape.

* * * * *